US005491478A

United States Patent [19]

de la Luz et al.

[11] Patent Number: 5,491,478

[45] Date of Patent: Feb. 13, 1996

[54] SEAL MEMBRANE WITH INTEGRAL MICROPHONE SUPPORT

[75] Inventors: Juan B. de la Luz, Miami; John C. Dzung, Plantation; Orlando Hernandez; Jeff R. Beasley, both of Sunrise, all of Fla.

[73] Assignee: Motorola, Inc., Schaumburg, Ill.

[21] Appl. No.: 250,874

[22] Filed: May 31, 1994

[51] Int. Cl.[6] ..... H01H 9/00

[52] U.S. Cl. ..... 341/22; 381/91; 381/169; 381/188; 381/189; 181/171

[58] Field of Search ..... 341/22; 381/87–90, 381/91, 169, 188, 189; 181/141, 148, 149, 150, 153, 154–156, 171, 172

[56] References Cited

U.S. PATENT DOCUMENTS 4,920,564 4/1990 Allkins ..... 381/189

5,265,274 11/1993 Knutson et al. ..... 455/347

*Primary Examiner*—John K. Peng

*Assistant Examiner*—Andrew Hill

*Attorney, Agent, or Firm*—Barbara R. Doutre

[57] ABSTRACT

A unitarily molded seal membrane (310) includes an integral microphone support (304) which includes a diaphragm (306). A cavity wall (406) is located about said diaphragm (306) on one side of the seal membrane (310). The cavity wall (406) defines a cavity area (410) for receiving a microphone (504). The cavity wall aligns the diaphragm (306) in front of the microphone (504), thereby allowing for environmental sealing of the microphone (504).

14 Claims, 3 Drawing Sheets

SEAL MEMBRANE WITH INTEGRAL MICROPHONE SUPPORT

TECHNICAL FIELD

This invention relates generally to seal membranes and more particularly to a seal membrane with integral microphone support.

BACKGROUND

In portable radio applications it is typically necessary to provide some form of water intrusion sealing for the internal microphone cartridge which is found within the radio housing. One prior art technique for sealing the microphone is shown in FIG. 1. This prior art technique uses a rubber boot 102 for retaining the microphone cartridge 104 to the radio housing 108. A separate water resistant layer of felt, GORE-TEX™, polyurethane membrane, or other water resistant material 106 is disposed between the rubber boot 102 and radio housing 108 and blocks microphone port 110, in order to protect the microphone cartridge 104 from water intrusion. Both the rubber boot 102 and water resistant layer 106 are attached to radio housing 108 using adhesives or other well known attachment techniques. A set of wires 112 interconnect the microphone cartridge to the radio electronics.

In FIG. 2, a second prior art technique for environmentally protecting the microphone cartridge 206 is shown. In this prior art technique, a rubber boot 208 which is pressure fitted to radio housing holds the microphone cartridge 206 in place. This method also requires that a felt or GORETEX™ layer 204 be attached to radio housing 202 between the microphone port and the microphone cartridge 206. Here again, a set of wires 210 interconnect the microphone cartridge to the rest of the radio electronics.

The prior art techniques for sealing an internal microphone as discussed above require a large number of parts and require a great amount of labor which increases the cost of producing a product having an internal microphone, such as a portable two-way radio. A need thus exists in the art for a seal which can provide environmental sealing to the internal microphone cartridge in a cost effective manner.

DETAILED DESCRIPTION OF THE PREFERRED EMBODIMENT

Figure 1:
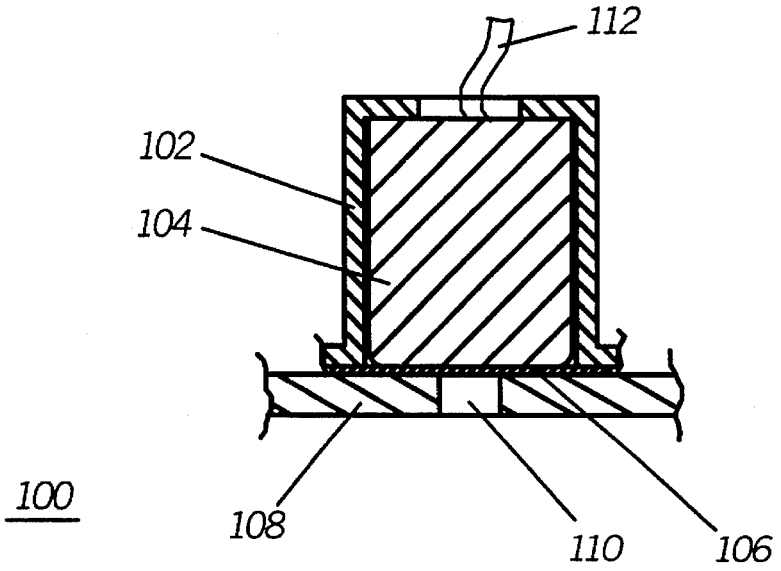
FIG.1 (PRIOR ART)
FIG. 1 shows a first prior art drawing of a microphone sealing structure.
Figure 2:
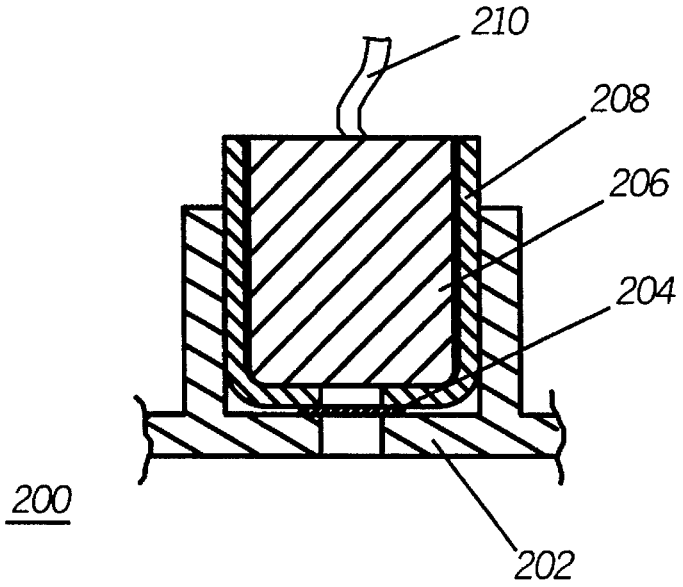
FIG.2 (PRIOR ART)
FIG. 2 shows a second prior art drawing of a microphone sealing structure.
Figure 3:
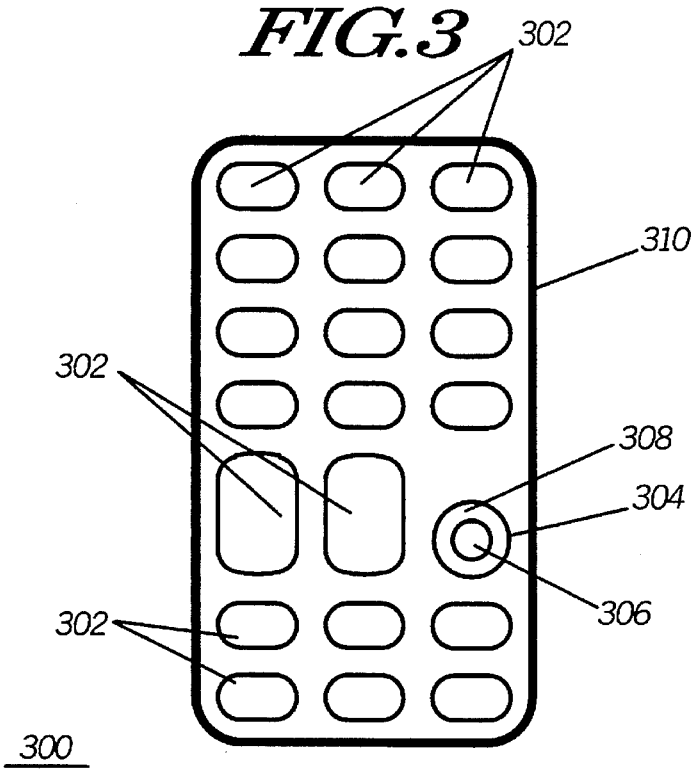
FIG. 3 shows a front view of a keypad in accordance with the present invention.

Referring now to the drawings and in particular to FIG. 3, a unitarily molded seal or seal membrane 300 in accordance with the present invention is shown. In FIG. 3, the preferred embodiment of a unitary elastomeric keypad having an integral microphone support is shown. Seal 310 includes a set of individual keys 302 which are integrally molded as part of the main body of seal 310. Seal 310 is preferably formed from an elastomeric material such as silicone, polyurethane, rubber, or other similar materials. Integrally formed into seal 310 is a microphone section 304 which includes tapered side walls 308 which form cone shaped area for directing sound waves towards the integral microphone diaphragm 306. Diaphragm 306 is formed as thin as possible in order to provide environmental protection to the microphone cartridge which is mounted in back of microphone section 304 while at the same time minimizing the distortion effect on the incoming sound waves. In the preferred embodiment, the diaphragm area 306 is approximately 0.1016 millimeter (0.004 inch) thick, although the thickness of the diaphragm 306 will depend on the specific application being designed for. For example, in designs where some distortion of the incoming sound waves is permissible, a thicker diaphragm can be used, while in applications where good sound reproduction is a requirement, a thinner wall (such as in the preferred embodiment) would be best. The thinness of the wall will also depend on the material used, the ability of the manufacturing process used in controlling the wall thickness, size of overall seal being designed, etc. Given the small diameter of diaphragm 306, very little distortion is generated by the diaphragm 306 since it tends to flap very little when sound waves push against it.

Figure 4:
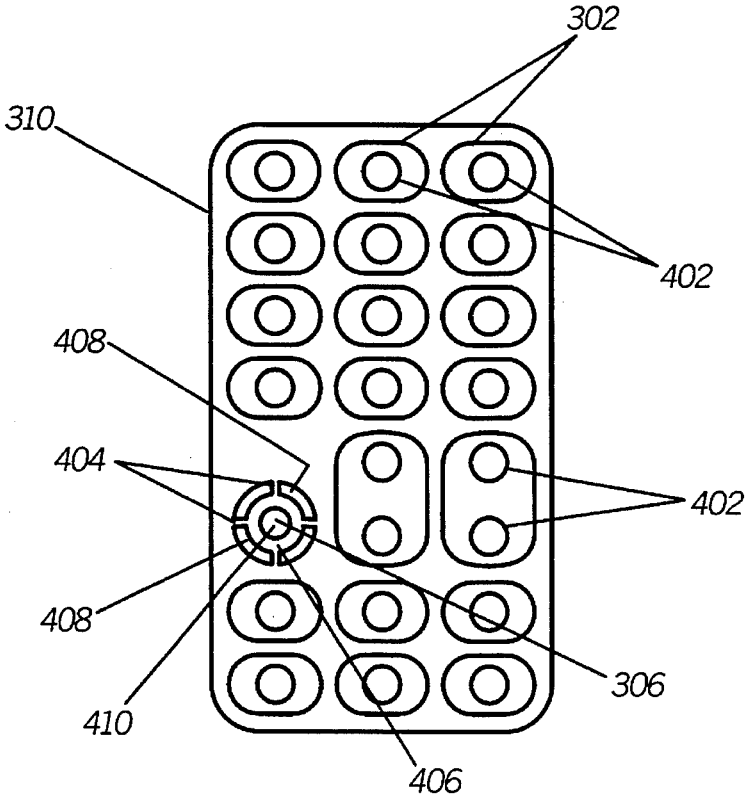
FIG. 4 shows the back view of the keypad of FIG. 3.

In FIG. 4, the back side of the unitarily molded seal member 300 is shown. Each of the individual key members 302 include a conductive carbon area 402 which is disposed on the back side of each individual key 302. When a key 302 is depressed, the conductive area 402 activates a circuit in the electronic device the seal member is a part of. The back side of the microphone section includes a cavity area 410 defined by a microphone cavity wall or support wall 406 which accepts the microphone cartridge 504 (shown in FIG. 5). A set of support members 404 provide support for the microphone support wall 406 since the sides of the support wall 406 are separated from the main body of the seal member 310 by slots 408. The set of support members 404 are an integrally molded portion of unitarily molded seal member 300 and are located between the main body of the seal member 300 and support wall 406. Slots 408 allow for the microphone support wall to expand outward when a microphone cartridge is pressure fit into cavity area 410. The separated support wall 406 also provides isolation to the microphone cartridge from movement of the seal member 310 caused by activation of keys 302, etc.

Figure 5:
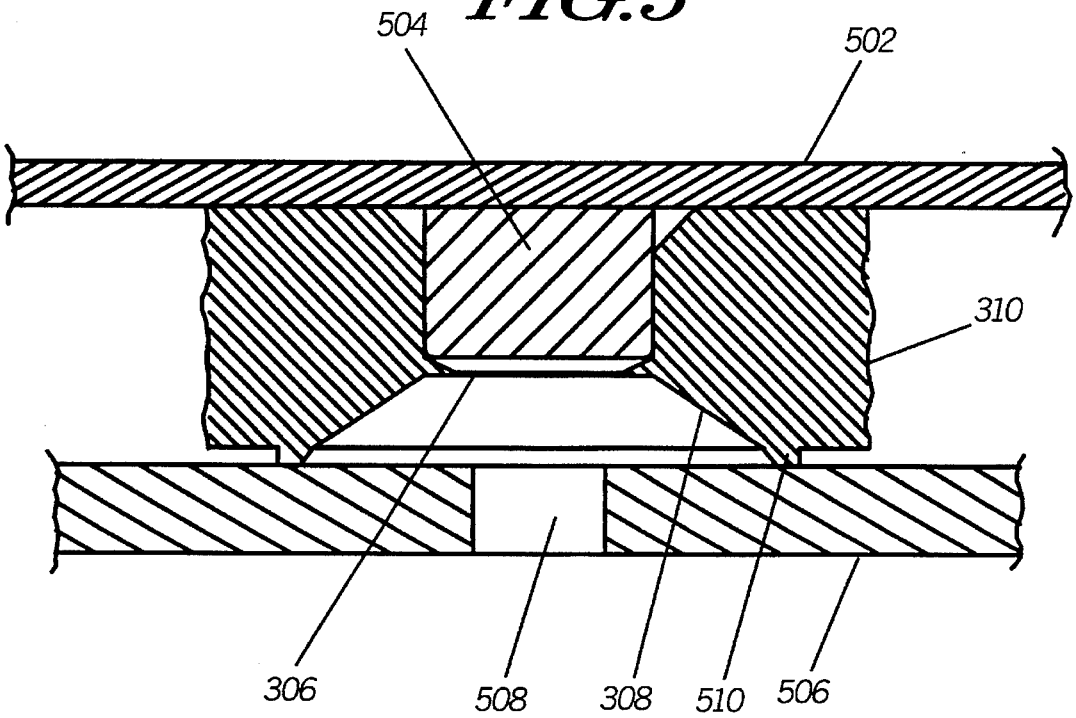
FIG. 5 shows a partial cross-sectional view of a microphone assembly in accordance with the present invention.

Referring now to FIG. 5, a partial cross-sectional view of the microphone section of the present invention sandwiched between a radio housing 506 and an internal printed circuit board 502 is shown. The housing member 506 such as a radio housing includes an aperture or microphone port 508 for allowing sound waves to travel through the port. The seal 310 is shown carrying a microphone cartridge 504. Microphone cartridge 504 is preferably pressure fit into the cavity found in seal 310. The thin silicone diaphragm 306 is positioned in front of the microphone cartridge 504 and provides minimum distortion to sound waves entering the microphone cartridge while providing for environmental sealing of the microphone 504. The tapered side walls 308 form a cone shape which help to concentrate incoming sound waves towards diaphragm 306. A perimeter seal ledge 510 which is part of seal 310 is located about the cone shape area helps provide a good pressure fit against the housing member. When seal 310 is pressure fit against housing member 506, seal ledge 510 compresses and provides for a good environmental and acoustical seal around aperture 508. This helps prevent any moisture or dust from entering the electronics found inside of the housing.

Figure 6:
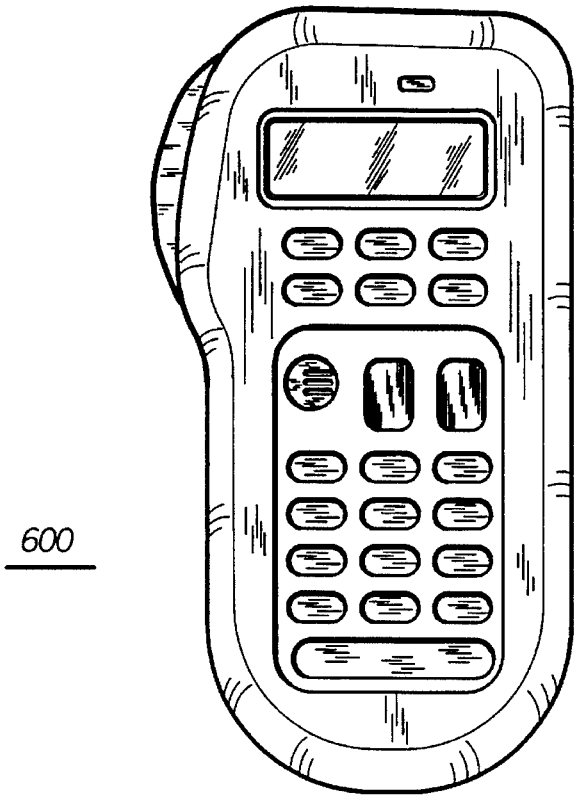
FIG. 6 shows an electronic device using the integrated seal member of the present invention.

In FIG. 6, an electronic device such as a remote microphone/keypad device 600 is shown. The remote keypad/microphone 600 is typically connected to a communication device such as a two-way radio via a cable assembly which is not shown. The remote keypad/microphone 600 allows for remote operation of the two-way radio as is typically required in a vehicular environment. The keypad/microphone device 600 includes the unitarily molded seal in this case an elastomeric keypad having an integral microphone support as shown in FIGS. 3 and 4. The elastomeric keypad seals the internal electronics from environmental intrusion such as water and dust, and also provides a seal for the microphone cartridge which is located inside of the remote microphone keypad housing.

In summary, the present invention provides for a unitarily molded seal membrane such as an elastomeric keypad 300 which includes an integral microphone support section. The invention also provides for a simple and cost effective way of environmentally and acoustically sealing and supporting a microphone cartridge 504. The integral microphone support includes a resilient cavity wall 406 which allows for pressure fitting of the microphone cartridge 504 within a cavity area 410. This provides for ease of assembly and overall cost reduction of the finished assembly. The microphone support section also preferably includes tapered walls 308 (forming a cone shaped front portion) in front of diaphragm 306 which help direct incoming sound waves towards microphone cartridge 504. Although the preferred embodiment has been shown as a elastomeric keypad, a unitarily molded seal having an integral microphone support section alone could be designed for those application where a keypad section is not required.

What is claimed is:

1. A unitarily molded seal having an integral microphone support for supporting a microphone, comprising:

a diaphragm integrally formed within the seal; and a cavity wall integrally formed about said diaphragm, the cavity wall and diaphragm defining a cavity area for receiving said microphone.

2. A unitarily molded seal as defined in claim 1, further comprising:

first and second sides, the cavity wall located on the second side;

a tapered side wall integrally formed about the diaphragm on the first side.

3. A unitarily molded seal as defined in claim 1, further comprising:

first and second sides, the cavity wall located on the second side; and a seal ledge integrally formed about said diaphragm on said first side.

4. A unitarily molded seal as defined in claim 1, wherein the diaphragm and said cavity wall are integrally formed from silicone.

5. A unitarily molded seal as defined in claim 2, further comprising:

a main seal body; and a plurality of support members integrally formed between said main seal body and said cavity wall and forming a plurality of slots between said cavity wall and said main seal body, the plurality of slots allowing the cavity wall to expand towards the main seal body when said microphone is placed within the cavity area.

6. An unitarily molded elastomeric keypad, comprising:

a main body;

a plurality of integrally formed keys located about said main body; and a microphone support section integral to the main body for receiving a microphone, the microphone support section including:

a diaphragm; and a cavity wall located about said diaphragm, the cavity wall defining a cavity area for receiving said microphone.

7. An unitarily molded elastomeric keypad as defined in claim 6, further comprising:

the main body including first and second sides and the cavity wall is located on the second side; and a tapered side wall integral to the main body and located about the diaphragm on the first side.

8. An unitarily molded elastomeric keypad as defined in claim 6, wherein: the main body includes first and second sides and the diaphragm comprises an area of reduced thickness on said main body between said first and second sides.

9. An unitarily molded elastomeric keypad as defined in claim 8, further comprising:

a seal ledge integral to the main body and located about said diaphragm on said first side.

10. An unitarily molded elastomeric keypad as defined in claim 1, wherein the elastomeric keypad is formed from silicone.

11. Am assembly, comprising:

a housing member having an aperture;

a microphone cartridge;

a unitarily molded seal located against the housing member, the seal including:

a diaphragm integrally formed within the seal and located substantially in front of the housing member aperture; and a cavity wall integrally formed within the seal and located about said diaphragm, the cavity wall defining a cavity area for receiving said microphone cartridge, the diaphragm located between the microphone cartridge and the housing member aperture.

12. An assembly as defined in claim 11, wherein the seal includes first and second sides with the cavity wall located on the second side; and a tapered side wall integrally formed within the seal and located about the diaphragm on the first side, the tapered side wall holding the diaphragm a certain distance away from the housing member aperture.

13. An assembly as defined in claim 12, wherein the seal includes an integral seal ledge located about said diaphragm on said first side, the seal ledge is compressed against the housing member and is located about the housing member aperture.

14. An assembly as defined in 11, wherein the seal is formed from silicone.

* * * * *

UNITED STATES PATENT AND TRADEMARK OFFICE

CERTIFICATE OF CORRECTION

PATENT NO. : 5,491,478

DATED : February 13, 1996

INVENTOR(S) : de la Luz, et al.

It is certified that error appears in the above-indentified patent and that said Letters Patent is hereby corrected as shown below:

Column 4, line 34, delete "1" and insert therefor --6--.

Column 4, line 36, delete "Am" and insert therefor --An--.

Signed and Sealed this

Seventeenth Day of September, 1996

*Attest:*

Bruce Lehman

BRUCE LEHMAN

*Attesting Officer*

*Commissioner of Patents and Trademarks*